United States Patent [19]

Schechter

[11] Patent Number: 4,583,510

[45] Date of Patent: Apr. 22, 1986

[54] ELECTROMAGNETIC DISTRIBUTOR-TYPE MULTIPLUNGER FUEL INJECTION PUMP

[75] Inventor: Michael M. Schechter, Southfield, Mich.

[73] Assignee: Ford Motor Company, Dearborn, Mich.

[21] Appl. No.: 689,126

[22] Filed: Jan. 7, 1985

[51] Int. Cl.[4] ..... F02M 39/00

[52] U.S. Cl. ..... 123/458; 123/459; 123/506

[58] Field of Search ..... 123/446, 449, 451, 458, 123/459, 506; 417/442

[56] References Cited

U.S. PATENT DOCUMENTS

| | | | |
|---|---|---|---|
| 1,664,608 | 4/1928 | French | 123/458 |
| 2,016,503 | 10/1935 | Kenworthy | 417/442 |
| 2,287,702 | 6/1942 | Nichols | 123/446 |
| 3,744,465 | 7/1973 | Voss et al. | 123/451 |
| 4,459,963 | 7/1984 | Gross et al. | 123/458 |
| 4,479,475 | 10/1984 | Babitzka | 123/458 |
| 4,497,299 | 2/1985 | Schechter | 123/451 |

FOREIGN PATENT DOCUMENTS

| | | | |
|---|---|---|---|
| 55654 | 7/1982 | European Pat. Off. | 123/446 |
| 2060051 | 4/1981 | United Kingdom | 123/446 |

*Primary Examiner*—Magdalen Y. C. Moy

*Attorney, Agent, or Firm*—Clifford L. Sadler; Robert E. McCollum

[57] ABSTRACT

An electromagnetically controlled fuel injection pump of the spill port, continuously rotating, multiplunger type in which fuel flow to and from a pair of plunger barrels is controlled by a single solenoid valve controlling a spill port, each of the plungers in turn controlling the injection of fuel to two or three engine cylinders.

4 Claims, 7 Drawing Figures

ELECTROMAGNETIC DISTRIBUTOR-TYPE MULTIPLUNGER FUEL INJECTION PUMP

This invention relates to an electromagnetic fuel injection pump of the type in which fuel delivery and injection timing are controlled by a solenoid valve that controls spill port closure duration and timing. A distributor-type pump concept, in which a single plunger controlled by a single solenoid delivers fuel to all cylinders of a multicylinder engine, offers one of the most economical and compact pump layouts. However, in engines with long duration of injection and wide range of injection timing advance, this concept is often not feasible since there is not enough time for one plunger to serve all cylinders.

This invention describes a pump concept in which a single solenoid valve controls the operation of two plungers each delivering fuel to two or three engine cylinders. Thus, a single solenoid can control a 4 or 6 cylinder engine. In some cases, such as an 8 cylinder engine, two solenoids may be used.

Plunger type fuel injection pumps with solenoid controlled spill ports are known. For example, U.S. Ser. No. 570,556, Schechter, Plunger Type Fuel Injection Pump and now U.S. Pat. No. 4,497,299, assigned to the assignee of this invention, shows a multi-plunger, spill port type pump having a single solenoid controlling the fuel flow operation with respect to two plungers. However, it does not show one solenoid valve controlling the fuel flow operation of two plungers that in turn each control flow to at least a pair of engine cylinders.

It is, therefore, an object of the invention to provide an economical and efficiently constructed fuel injection pump in which a single solenoid controlled fuel spill valve controls the operation of two pump plungers each delivering fuel to at least two engine cylinders.

Other objects, features and advantages of the invention will become more apparent upon reference to the succeeding, detailed description thereof, and to the drawings; wherein, FIG. 1 is a cross-sectional view of a portion of an internal combustion engine embodying the invention, taken on a plane indicated by and viewed in the direction of the arrows I—I in FIG. 2;

Figure 1:
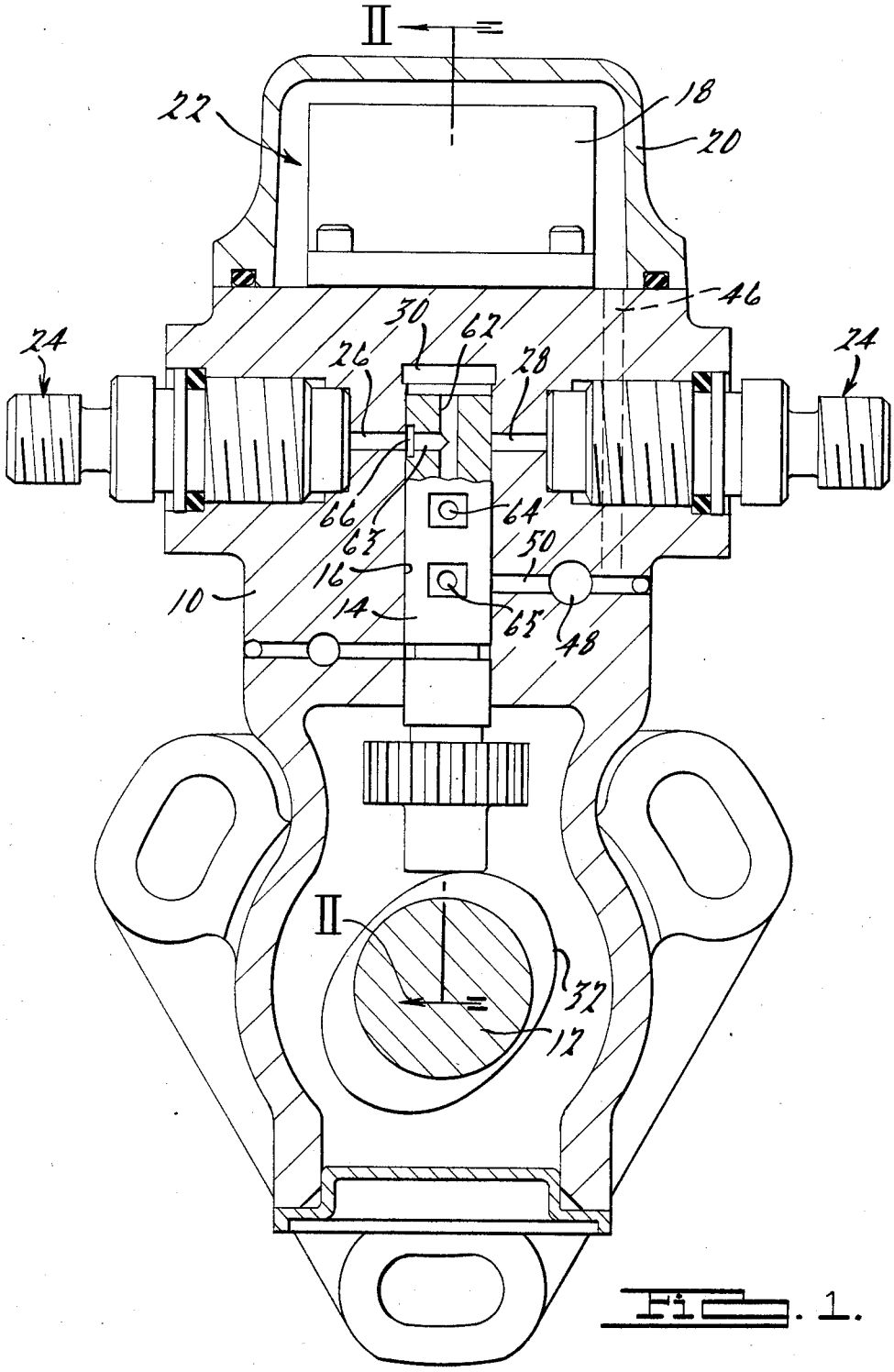
Figure 2:
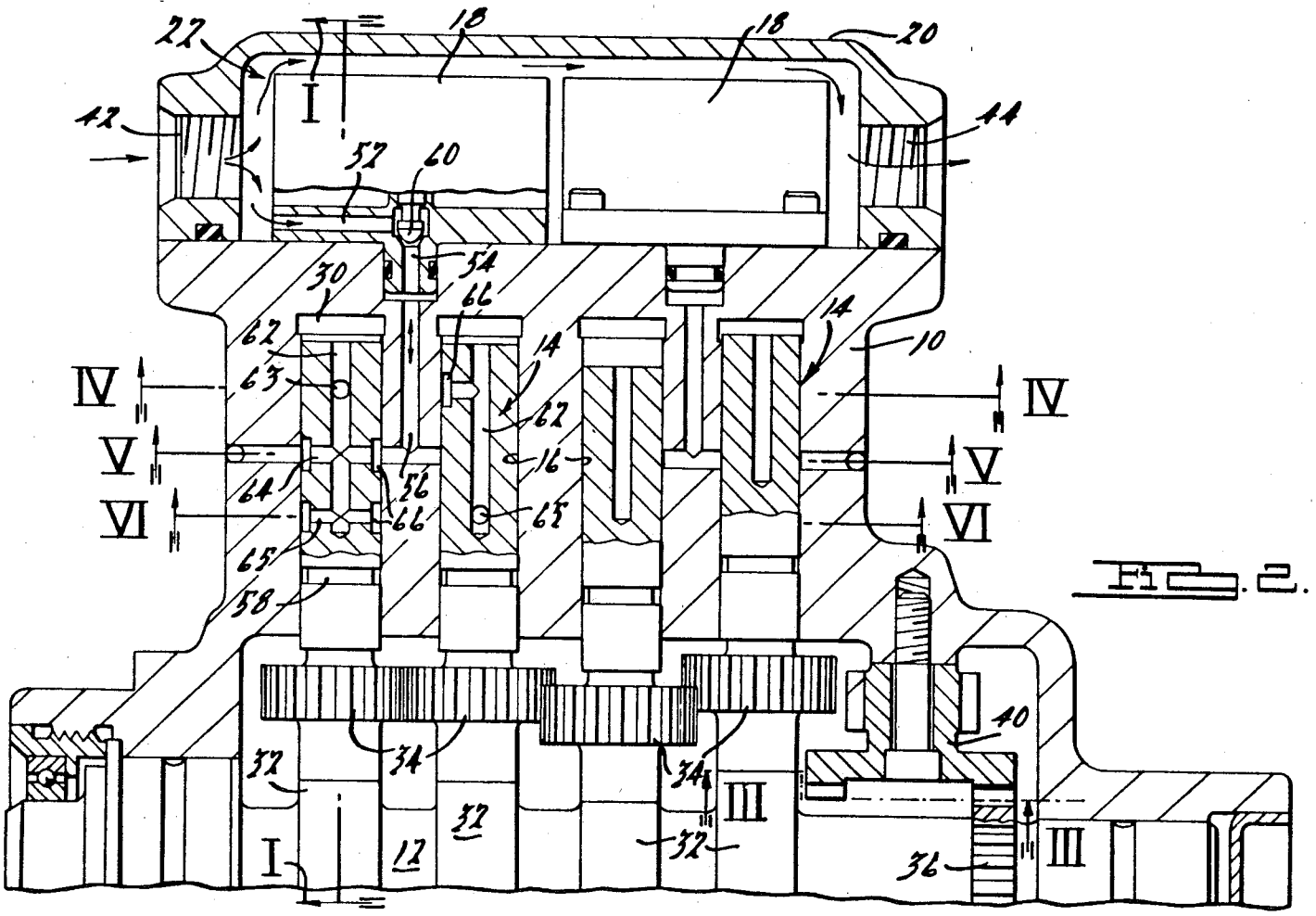
FIG. 2 is a cross-sectional view taken on a plane indicated by and viewed in the direction of the arrows II—II of FIG. 1.

FIGS. 1 and 2 illustrate a pump, suitable for an eight cylinder engine. It includes a pump housing 10 that contains an engine driven camshaft 12 and four identical plungers 14 each mounted for a sliding movement in a bore or barrel 16. Two solenoid valve assemblies 18 to be described later are mounted on the top of the pump housing and are enclosed by a common cover 20 defining a solenoid valve fuel chamber 22. Eight delivery valves 24 (four on each side) are screwed into the pump housing. The delivery valves can be of any well known retraction type, opening only above a predetermined fuel pressure to deliver fuel into an injection line leading to an individual engine cylinder. Passages 26 and 28 formed in the housing connect each plunger barrel 16 with delivery valves on opposite sides of the pump.

Rotation of the camshaft 12 causes reciprocating motion of the plungers 14 upwardly in a pumping stroke, and downwardly in a fuel intake or return stroke. Fuel pressure in a plunger spill/fill chamber 30 defined at the top of the plunger barrels 16 assures that the plungers follow the profile of the camlobes 32. In some cases, return springs may be used to assure fast plunger return. The profile of each camlobe 32 assures that each plunger 14 completes two full strokes during one revolution of the camshaft, and that the duration of the upstroke and the downstroke is unequal. The upstroke in this case takes place during 120° of camshaft rotation, while the downstroke lasts only 60° of camshaft rotation.

Figure 3:
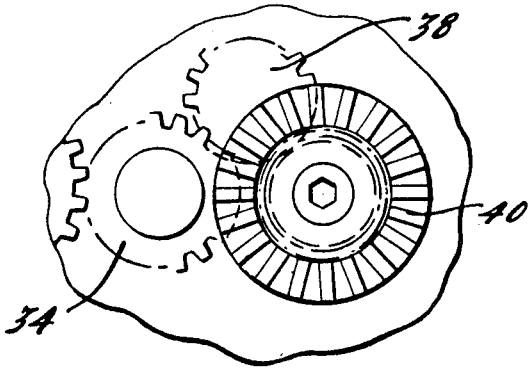
FIG. 3 is a plan view from the bottom looking up taken along the lines indicated by the arrows III—III in FIG. 2.

The four camlobes 32 are phase shifted 45° relative to each other in the following order: 1-3-2-4. Each plunger is equipped with a gear 34. All four gears are meshed with each other, and form a common gear train engaged with a gear 36 on the camshaft through an idler 38 and an intermediate gear set 40. (FIG. 3) Rotation of the camshaft, therefore, results in rotation of all four plungers about their axes. The gear ratio between the gear 36 and the gears 34 is 1:1; and, therefore, each plunger 14 completes one full revolution during each revolution of the camshaft. The gears 34 can be made with helical teeth and in that case depending on the direction of the plunger stroke, the relative axial motion of engaged gears increases or decreases the instantaneous angular velocity of plunger rotation relative to that of the camshaft. The directions of the helix angle of the gears are selected so that each plunger rotates slower during its upstroke when fast rotation is undesirable, and faster during the downstroke.

Supply fuel from a low pressure supply pump, not shown, is delivered to the solenoid chamber 22 through an inlet port 42, and flows around the solenoid assembly to cool it. The excess of fuel flows out through a return port 44 to a fuel tank or to the intake side of the pump. A passage 46 (FIG. 1) connects the chamber 22 with a supply gallery 48 (FIG. 6) from which four supply channels 50 lead to the four plunger barrels 16. A parallel flow connection between the chamber 22 and the plunger barrels 16 also is provided through a channel 52 (FIG. 2) and a spill port 54 in the solenoid assembly, and through a T-shaped passage 56 in the pump housing. Each solenoid is thus connected with two plungers. An annular groove 58 on each plunger prevents fuel leakage into the camshaft sump.

Each solenoid assembly 18 characteristically would include a solenoid with an armature secured to a spill port control valve 60. The valve normally would be biased by spring means, or fuel pressure, as the case may be, to the position shown opening the spill port 54. Energization of the solenoid would move valve 60 downwardly to shut or close the spill port 54 and thus permit pressurization of the plunger barrel chambers 30 whenever the associated plunger moves upwardly through its pumping stroke. As long as the spill port remains open, the upstroke of a particular plunger will merely force the fuel back to the supply pump through the open spill port.

The duration and timing of energization of the solenoid will be determined by a microprocessor unit, not shown, that will vary the voltage charge to the solenoid as a function of selected engine parameters, such as load, speed, temperature, manifold pressure level, etc., to suit each particular engine operating condition to inject the required quantity of fuel to each engine cylinder in the proper order.

Figure 4:
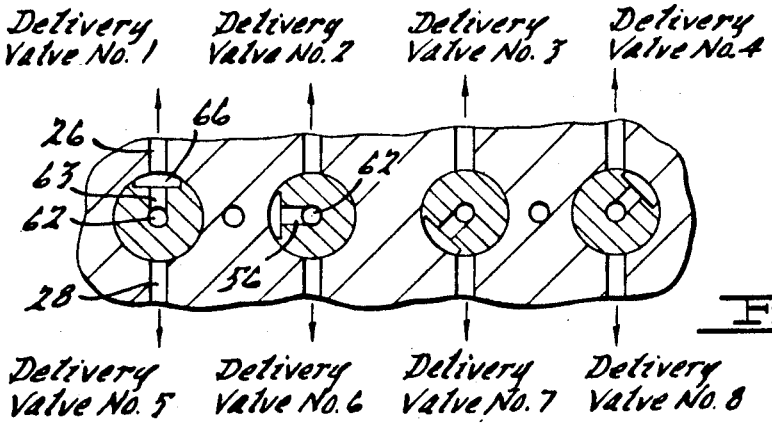
FIGS. 4, 5 and 6 are schematic cross-sectional views taken on planes indicated by and viewed in the direction of the arrows IV—IV, V—V and VI—VI, respectively, in FIG. 2.
Figure 5:
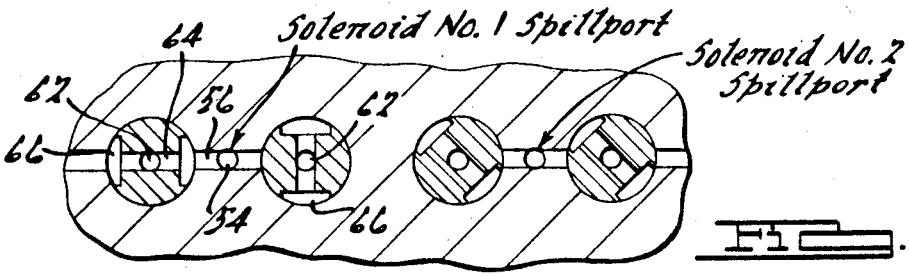

Each plunger 14 has an internal axial bore 62 and three crossbores 63, 64 and 65. The plane of the crossbore 63 is perpendicular to the plane of the crossbores 64 and 65. Slots 66 at the ends of each of the crossbores determine the duration of connections with corresponding passages and channels in the pump housing. The plungers 14 are rotationally phase shifted relative to each other. The pattern of this phase shift is illustrated schematically in FIGS. 4–6 where, for clarity, the four plungers are labeled Nos. 1–4, the delivery valves are Nos. 1–3, and the solenoid spill ports are Nos. 1 and 2.

Figure 6:
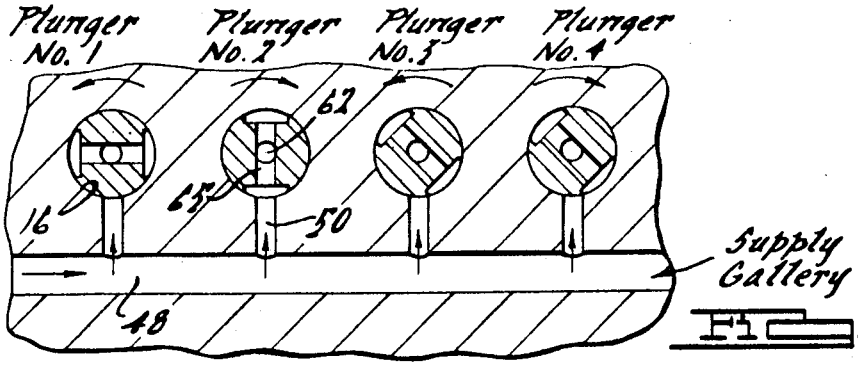

FIG. 2 shows the plunger No. 1 halfway in its upstroke and plunger No. 2 halfway in its downstroke. As can be seen from FIGS. 1, 2 and 5, the spill port 54 controlled by solenoid No. 1 is connected by passage 56 to the axial bore passage 62 in plunger No. 1, but disconnected from the bore 62 in plunger No. 2. At the same time, plunger No. 1 is connected through passage 26 (FIGS. 1 and 4) with delivery valve No. 1 and disconnected from the supply gallery passage 50, while the plunger No. 2 is disconnected from delivery valves Nos. 2 and 6 (FIG. 4) and connected with the supply gallery 48 (FIG. 6). Fuel now is displaced from the barrel 16 and chamber 30 of plunger No. 1 through the axial bore 62, crosshole 64, T-shaped passage 56, spill port 54, and the channel 52. The fuel chamber 30 of plunger No. 2 now is filled with fuel from the supply gallery 48 (FIGS. 2 and 6) through the supply channel 50, crosshole 65, and axial bore 62. This type of hydraulic connection lasts for a 90° camshaft rotation and constitutes the No. 1 plunger operational window. During this period of time, activation of solenoid No. 1 and the resulting closure of spill port 54 by the spill valve 60 will have no effect on the operation of plunger No. 2, but it will trap the fuel in the fuel chamber 30 of plunger No. 1. The rising pressure of the trapped fuel will open delivery valve No. 1 and, for the duration of the spill valve closure, plunger No. 1 will displace fuel into an injection line connected to delivery valve No. 1. This will result in fuel injection into an engine cylinder through a nozzle on the other end of the injection line. Deactivation of the solenoid will open the spill port 54 and terminate the fuel injection. As stated previously, controlling the timing of the solenoid activation and deactivation controls both the fuel quantity and injection timing.

Rotating the camshaft 45° will rotate the plungers and position plunger No. 1 in its fuel intake or downstroke, while plunger No. 2 will be in its pumping or upstroke. The pattern of hydraulic connections will be reversed from that previously described. The fuel chamber 30 for plunger No. 2 now will be connected to the spill port 54 and delivery valve No. 2, while plunger No. 1 will be connected only with the supply gallery 48. This hydraulic connection also lasts for a 90° camshaft rotation and constitutes the No. 2 plunger operational window. During this period of time, activation of solenoid No. 1 will result in fuel displacement from the fuel chamber 30 of plunger No. 2 into an injection line connected to delivery valve No. 2.

During the next 180° camshaft rotation, the above described process will be repeated again, and the fuel will be displaced from the fuel chambers of plungers No. 1 and 2 into injection lines connected to delivery valves No. 5 and No. 6. Therefore, solenoid No. 1 is activated four times during a single camshaft revolution, initiating and controlling fuel delivery to four different cylinders.

Figure 7:
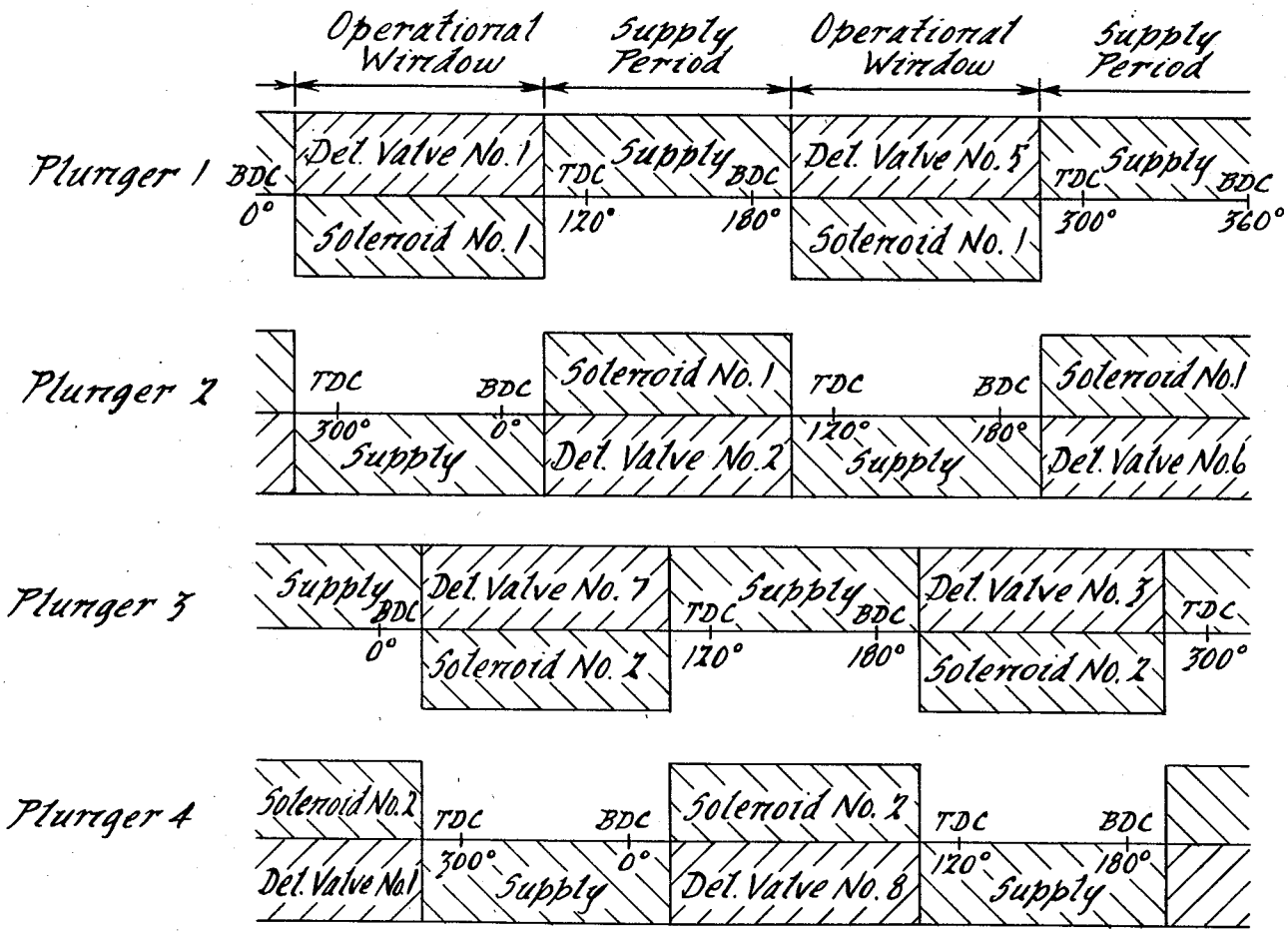
FIG. 7 is a bargraph chart illustrating the phase shifting movement of the pump plungers.

The operation of solenoid No. 2 and plungers No. 3 and No. 4 is identical to that as described in connection with solenoid No. 1 and plungers No. 1 and No. 2, except that everything is time shifted a 45° camshaft rotation so that injections caused by solenoid No. 2 take place in between the injections caused by solenoid No. 1. The resulting working order of the 8 delivery valves is: 1-7-2-8-5-3-6-4 with injections taking place in steps of 45° camshaft rotation. A summary of the hydraulic connections for all four plungers is shown in bar graph form in FIG. 7. The starting point is the bottom dead center position of plunger No. 1. For example, one 90° rotation of the camshaft after plunger No. 1 has been moved 15° from BDC and connected to the spill port closed by solenoid valve No. 1 results in the following: at 45° camshaft rotation, plunger No. 3 will be connected to the closed spill port and initiate fuel injection past delivery valve No. 7. Plunger No. 2 will be connected to the supply gallery 48, while plunger No. 4 will have just completed fuel injection past delivery valve No. 4, and will be disconnected from the spill port 54 and now connected to the supply gallery 48. 45° later, plunger No. 1 will have completed injection and be disconnected from the spill port and connected to the supply gallery 48. Plunger No. 2 now will be disconnected from the supply gallery 48 and connected to the closed spill port 54 and begins injecting fuel past delivery valve No. 2. Plunger No. 3 continues to inject fuel through delivery valve 7 for another 45° camshaft rotation, while plunger No. 4 continues to be connected to the supply gallery 48.

The remaining sequential operation for a further 270° camshaft rotation follows as a matter of course, and, therefore, further explanation is believed to be unnecessary.

From the foregoing, it will be seen that the invention provides a multi-plunger pump with continuously rotating plungers, controlled by a single solenoid controlling a spill port, and each of the plungers controlling fuel delivery to two or three engine cylinders. It will be clear from the diagram in FIG. 6 that the operation of each plunger is a continuous sequence of equal duration periods, with 90° duration operational windows, during which injection takes place, being separated by 90° duration supply periods, during which the plunger barrel and fuel chamber is refilled.

While the invention has been shown and described in its preferred embodiment, it will be clear to those skilled in the arts to which it pertains that many changes and modifications may be made thereto without departing from the scope of the invention.

I claim:

1. A fuel injection pump of the multi-plunger, fuel distributive spill port type for use with a multi-cylinder engine for controlling the sequential and phased injection of fuel into at least four engine cylinders through the reciprocation and rotation of only a pair of plungers, including a pair of plungers each slidably mounted in a plunger barrel for reciprocation by an engine driven camshaft through a pumping stroke in one direction and oppositely through a return fuel intake stroke, the camshaft having means thereon reciprocating each plunger through four strokes for each camshaft revolution, and rotating each plunger one revolution for each revolution of the camshaft, a fuel spill/fill chamber defined at the end of each plunger, each plunger having a number of axially spaced internal passages connected to the chamber and alignable on a one-at-a-time basis as a function of reciprocation and rotation of the plunger first with a low pressure fuel supply passage for filling of the chamber with fuel during the intake stroke of its plunger, and secondly with a fuel spill passage for the passage of fuel thereinto from the chamber during the pumping stroke of its associated plunger, and thirdly, with a pair of angularly spaced fuel discharge passages each containing a spring closed delivery valve connected to an individual engine cylinder for delivery of fuel thereto upon pressurization of the fuel in the chamber above a predetermined value, and a single solenoid operable valve movable for blocking the spill passage to thereby permit pressurization of the plunger chamber during its pumping stroke, the fuel delivery volume being controlled by the duration of energization of the solenoid, whereby only one engine cylinder is injected with fuel at any one time.

2. A pump as in claim 1, wherein the means for rotating the plungers comprise gear means on each of the plungers meshing with one another and operatively meshing with a gear means driven by the camshaft.

3. A pump as in claim 2, wherein the gear means are formed with helical teeth providing a slower rotation of the plunger during its pumping stroke than during its return fuel intake stroke to thereby control the duration of alignment of the plunger internal passages with the other named passages.

4. A pump as in claim 1, wherein the internal passages of each plunger comprise an axial bore connecting the fuel chamber to first and second axially spaced pairs of diametrically opposite slots in the periphery of the plunger, and to a third peripheral slot axially spaced from the remaining slots, rotation of the camshaft 45° from a base position aligning one of the slots of one plunger with the spill passage while filling the fuel chamber of the other plunger and misaligning the remaining slots from the other passages, rotating the camshaft in increments of additional 45° to complete one revolution sequentially connecting the fuel chambers of the two plungers individually and one-at-a-time to the remaining delivery valves and engine cylinders.

* * * * *